US006480612B2

(12) United States Patent
Cho

(10) Patent No.: US 6,480,612 B2
(45) Date of Patent: Nov. 12, 2002

(54) HOLDER-RING FOR EARPHONE PLUG

(75) Inventor: Kyoung Soon Cho, Kyunggi-Do (KR)

(73) Assignee: Koryo Industrial Co., Ltd. (KR)

( * ) Notice: Subject to any disclaimer, the term of this patent is extended or adjusted under 35 U.S.C. 154(b) by 0 days.

(21) Appl. No.: 09/877,683

(22) Filed: Jun. 8, 2001

(65) Prior Publication Data

US 2001/0050997 A1 Dec. 13, 2001

(30) Foreign Application Priority Data

Jun. 9, 2000 (KR) ..... 00-16340

(51) Int. Cl.[7] ..... H04R 25/00
(52) U.S. Cl. ..... 381/380; 381/374
(58) Field of Search ..... 381/380, 374, 381/371, 322, 328; 379/430; 181/129, 130, 135

(56) References Cited

U.S. PATENT DOCUMENTS 2,363,175 A * 11/1944 Grossman
3,301,253 A * 1/1967 Glorig
3,415,246 A * 12/1968 Hill.
4,965,838 A * 10/1990 Kamon et al.
4,981,194 A * 1/1991 Kamon et al.
5,048,092 A * 9/1991 Yamagishi et al.
5,712,453 A * 1/1998 Bungardt et al.
5,953,435 A * 9/1999 Mullin et al.

* cited by examiner

*Primary Examiner*—Sinh Tran
(74) *Attorney, Agent, or Firm*—R W Becker & Associates; R W Becker

(57) ABSTRACT

A holder-ring for an earphone plug is provided. The holder-ring has a main cylindrical body. A flange is integrally formed at the upper end and extends outward and downward therefrom. The flange is spaced from the outer surface of the main cylindrical body by a predetermined distance so that a space opened at its lower end is provided therebetween. The flange has at its upper end a plurality of small through holes.

2 Claims, 3 Drawing Sheets

HOLDER-RING FOR EARPHONE PLUG

BACKGROUND OF THE INVENTION

1. Field of the Invention

The present invention relates to a holder-ring for an earphone plug, and more particularly, to a holder-ring for an earphone plug which functions as a cushion without causing discomfort to the ear, which improves its wearing feeling and stability, and prevents It from being withdrawn easily. This enables a user to hear sound from a speaker of the earphone clearly by preventing resonance in an ear canal, and to hear a measure of sound from outside, when it is worn in an ear canal opening.

2. Description of the Prior Art

A common earphone is generally configured to enable a user to privately listen to music or broadcasting information alone.

As illustrated in FIG. 1, this kind of earphone comprises a jack 1 adapted to be connected to a receptacle in a music center, a cable 2 having a predetermined length, and a pair of plugs 3 adapted to be inserted into ear holes and each having a speaker therein. Each of the plugs 3 is provided at its periphery with a holder-ring 4.

The holder-ring 4 is centrally formed (FIG. 2) with an aperture 4*a* to allow sound from the speaker to be transmitted to an ear drum membrane of the user, and is tightly fitted onto the periphery of the plug. The holder-ring 4 is generally made of flexible material such as rubber or silicone for improving comfort and fit.

However, such a conventional earphone may press or rub against and thus severely irritate the skin of the ear canal because it is almost forcibly inserted into the opening of the ear of the user to prevent it from being withdrawn from the ear, thereby causing its wearing comfort to be deteriorated and bringing about inflammation of the ear.

In addition, since the above-mentioned earphone has not been considered in the light of an ergonomic fit between the plug and the ear, the earphone has disadvantages in that it is easily and frequently withdrawn from the ear and thus is not stably worn in the ear canal.

Furthermore, since the plug of the earphone may block off the ear canal entirely, thereby causing resonance of sound from the speaker to take place, the earphone has disadvantages in that the user can hardly hear original sound or sound from outside, and therefore it is impossible to have a dialogue with another person, and thus it can give rise to a safety hazard.

SUMMARY OF THE INVENTION

Accordingly, the present invention has been made keeping in mind the above problems occurring in the prior art, and an object of the present invention is to provide a holder-ring for earphone plugs which functions as a cushion without causing discomfort to an ear, to improve its wearing feeling and stability, to prevent it from being withdrawn easily, and which enables a user to hear sound from a speaker of the earphone clearly, by preventing resonance in an ear canal, and to hear a measure of sound from outside, when it is worn in an ear canal opening.

In order to accomplish the above object, the present invention provides a holder-ring for an earphone plug, comprising a main cylindrical body having a central aperture; and a curved flange which is integrally formed at the uppermost periphery of the main body and then extended outward and downward therefrom, the flange being spaced from the outer sur face of the main cylindrical body by a predetermined distance so that a space that is open at its lower end is provided therebetween.

The flange may be provided at its upper end with a plurality of small through holes.

The flange may be sized such that the lower end of the flange does not reach to the lower end of the main body.

BRIEF DESCRIPTION OF THE DRAWINGS

The above and other objects, features and other advantages of the present invention will be more clearly understood from the following detailed description taken in conjunction with the accompanying schematic drawings, in which.

DETAILED DESCRIPTION OF THE INVENTION

Figure 1:
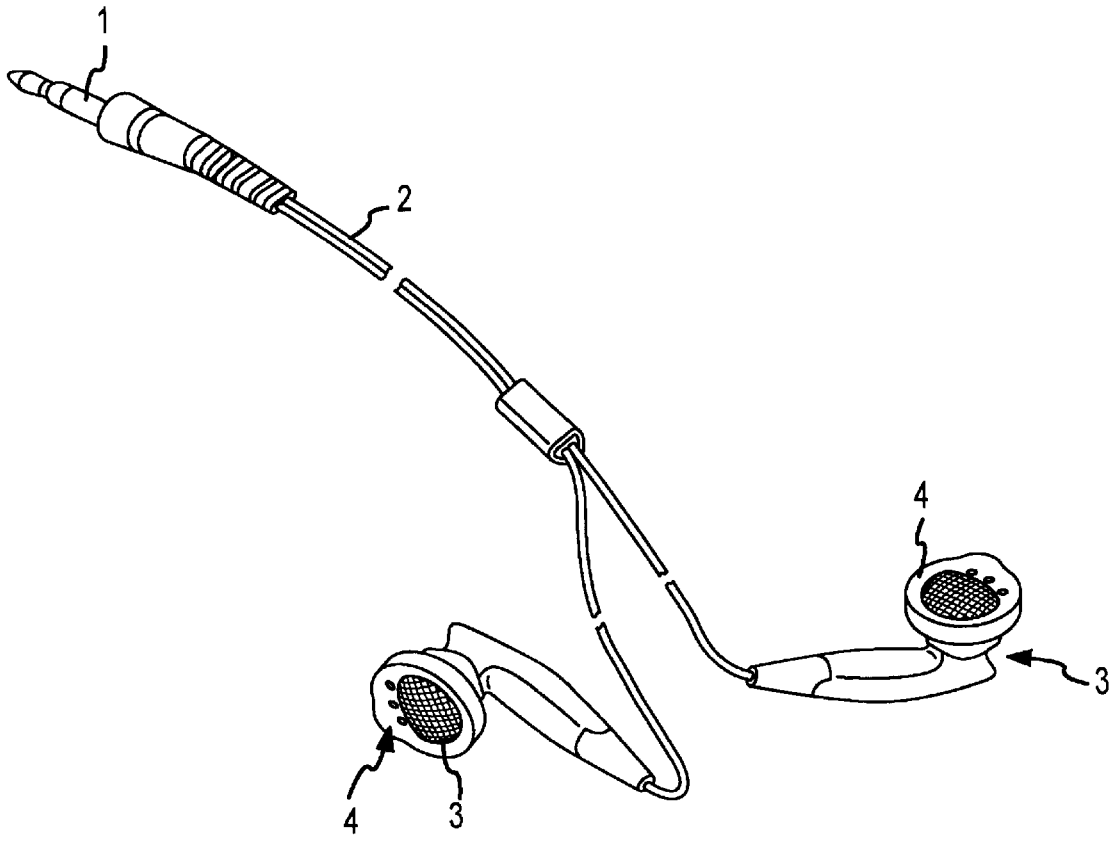
(PRIOR ART) FIG.1
FIG. 1 is a perspective view showing a conventional earphone.
Figure 2:
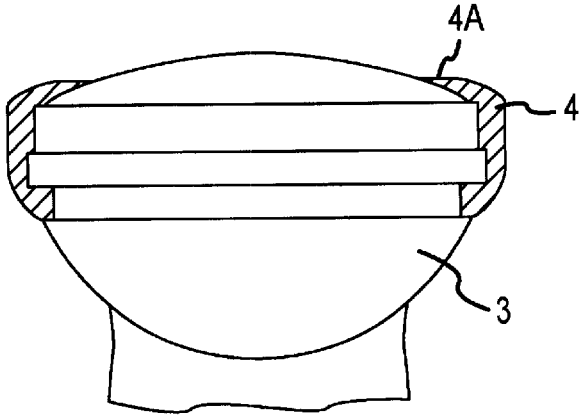
(PRIOR ART) FIG.2
FIG. 2 is a cross-sectional view showing a plug of a holder-ring of such a conventional earphone as shown in FIG. 1.

Reference should now be made to the drawings, in which the same reference numerals are used throughout the different drawings to designate the same or similar components.

Figure 3:
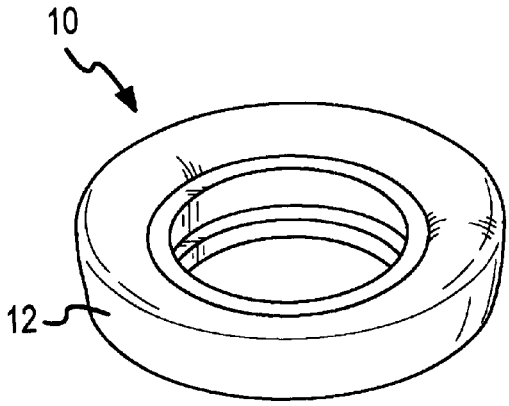
FIG. 3 is a perspective view of a holder-ring in accordance with the present invention.
Figure 4:
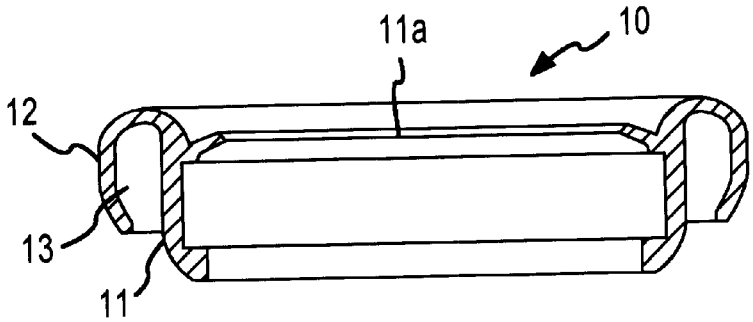
FIG. 4 is a cross-sectional view showing the holder-ring in FIG. 3.
Figure 5:
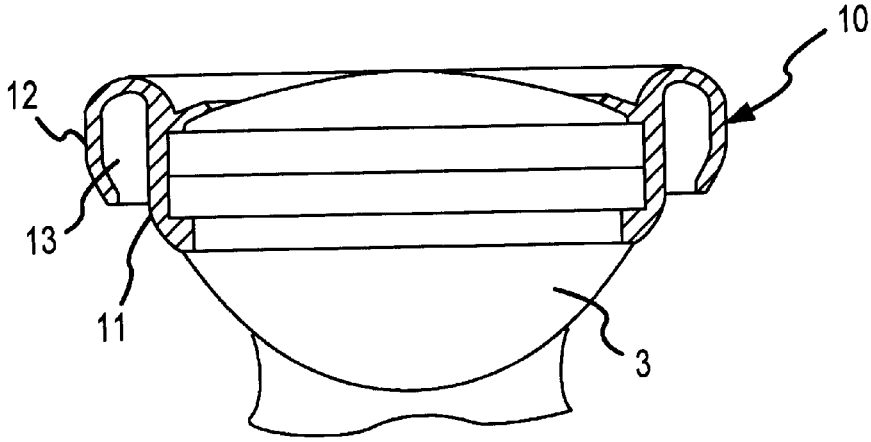
FIG. 5 is a cross-sectional view showing the holder-ring fitted onto a plug.

FIG. 3 is a perspective view of a holder-ring in accordance with the present invention, FIG. 4 is a cross-sectional view of the holder-ring, and FIG. 5 is a cross-sectional view showing the holder-ring fitted onto an earphone.

As illustrating in the drawings, the holder-ring 10 in accordance with the present invention comprises a main cylindrical body 11 having an aperture 11*a* therein, and a curved flange 12 which is integrally formed at the uppermost periphery of the main body 11 and then extends outward and downward therefrom.

The flange 12 is spaced from the outer surface of the main cylindrical body 11 by a predetermined distance so that a space 13, which is open at its lower end, is provided therebetween.

The flange 12 is preferably sized such that the lower end of the flange 12 does not reach to the lower end of the main body 11.

Figure 6:
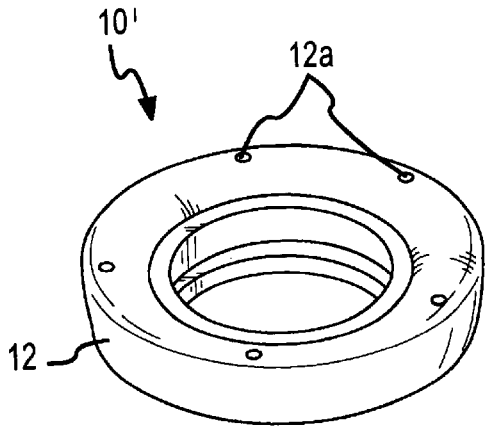
FIG. 6 is a perspective view showing a holder-ring in accordance with another embodiment of the present invention.
Figure 7:
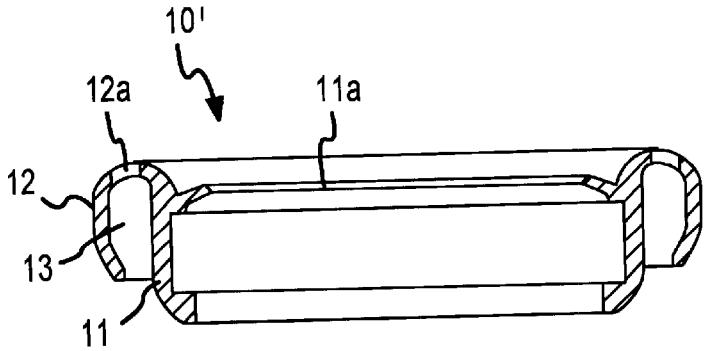
FIG. 7 is a cross-sectional view of the holder-ring in FIG. 6.
Figure 8:
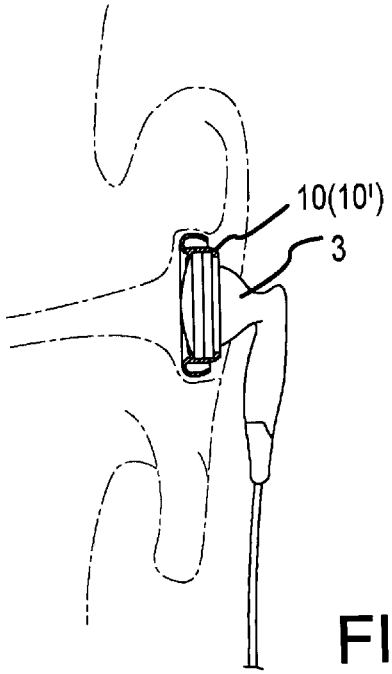
FIG. 8 is a schematic view illustrating the earphone worn in an ear canal of a user.

FIG. 6 and FIG. 7 show a holder-ring in accordance with an another embodiment of the invention. As illustrated in the drawings, the holder-ring 10' has a plurality of small through holes 12*a* formed at the upper curved portion of the flange 12.

The invention will now be described in terms of its function.

When the holder-ring 10 or 10' according to the present invention is fitted onto a plug 3 of an earphone and then inserted into an ear canal of a user, the flange 12 that is integrally formed at the main body 11 functions as a cushion while being compressed radially inward as it is inserted into the ear canal. The compressed flange 12 would exert force on the ear canal of the user, and tend to expand radially outward to allow the holder-ring to closely contact the ear canal, after the holder-ring has been inserted into the ear.

Therefore, the holder-ring will remain in a stable state in the ear without withdrawal from the ear or irritation to the ear, thereby improving the wearing comfort of the earphone.

Furthermore, since the small through holes 12*a* formed at the flange 12 of the holder-ring 10' enable the inner ear to receive outside air through the space, it is capable of preventing resonance in the inner ear, so that the user can hear sound from the speaker clearly, and is also capable of allowing the user to hear a measure of outside sound through the space 13.

That is, the invention is adapted to enable the user to hear sound clearly and to have a dialogue with another person, and to prevent safety hazards, by being alerted to emergencies.

As described above, the holder-ring for an earphone plug according to the present invention is configured such that the flange, which functions as a cushion, is integrally formed at its upper end with the main body of the holder-ring and is spaced at its major part from the main body, and the flange has a plurality of small through holes at its upper end. Therefore, the invention has advantages in that the holder-ring is capable of being comfortably worn because it does not irritate the ear, being stably worn without withdrawal from the ear canal, enabling the user to hear clearly sound from a speaker, and a measure of outside sound via the small through holes.

Although preferred embodiments of the present invention have been described for illustrative purposes, those skilled in the art will appreciate that various modifications, additions and substitutions are possible, without departing from the scope and spirit of the invention as disclosed in the accompanying claims.

What I claimed is:

1. A holder-ring for an earphone plug, comprising:

a main cylindrical body having a central aperture; and a curved flange which is monolithic ally formed with an uppermost periphery of the main body and then extends outward and downward therefrom, the flange being spaced from an outer surface of the main cylindrical body by a predetermined distance so that a space is provided therebetween, wherein said space is open remote from where said flange is formed with said main body, and wherein said flange is provided with a plurality of small through holes where said flange is formed with said main body.

2. A holder-ring for an earphone plug as set forth in claim 1, wherein said flange is sized such that an end of the flange remote from where the flange is formed with the main body does not extend to the lower end of the main body.

* * * * *